US007170234B2

(12) United States Patent
Chikugawa et al.

(10) Patent No.: US 7,170,234 B2
(45) Date of Patent: Jan. 30, 2007

(54) LIGHT EMITTING APPARATUS GENERATING WHITE LIGHT BY MIXING OF LIGHT OF A PLURALITY OF OSCILLATION WAVELENGTHS

(75) Inventors: Hiroshi Chikugawa, Higashihiroshima (JP); Masaaki Katoh, Higashihiroshima (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/158,399

(22) Filed: Jun. 20, 2005

(65) Prior Publication Data

US 2005/0280375 A1 Dec. 22, 2005

(30) Foreign Application Priority Data

Jun. 21, 2004 (JP) ..... 2004-182712

(51) Int. Cl.
*H05B 39/04* (2006.01)
*H05B 37/02* (2006.01)
*H05B 37/04* (2006.01)

(52) U.S. Cl. ..... 315/209 R; 315/287; 315/291

(58) Field of Classification Search ..... 315/291, 315/299, 307, 308, 312, 209 R, 210, 211, 315/246, 287, 362; 362/2, 227, 230, 231
See application file for complete search history.

(56) References Cited

U.S. PATENT DOCUMENTS 5,642,173 A * 6/1997 Tanimoto ..... 348/656
5,803,579 A * 9/1998 Turnbull et al. ..... 362/516
6,132,072 A * 10/2000 Turnbull et al. ..... 362/494
6,498,440 B2 * 12/2002 Stam et al. ..... 315/291
6,523,976 B1 * 2/2003 Turnbull et al. ..... 362/231
6,630,801 B2 * 10/2003 Schuurmans ..... 315/307
6,636,003 B2 * 10/2003 Rahm et al. ..... 315/179
2003/0156425 A1 * 8/2003 Turnbull et al. ..... 362/545
2005/0035939 A1 * 2/2005 Akiyama ..... 345/102
2005/0168564 A1 * 8/2005 Kawaguchi et al. ..... 347/237

FOREIGN PATENT DOCUMENTS

| | | |
|---|---|---|
| JP | 2001-144332 | 5/2001 |
| JP | 2001-209049 | 8/2001 |
| JP | 2001-272938 | 10/2001 |
| JP | 2002-533870 | 10/2002 |
| JP | 2002-324685 | 11/2002 |
| JP | 2002-368268 | 12/2002 |
| JP | 2004-086081 | 3/2004 |
| WO | WO-00/37904 A1 | 6/2000 |

* cited by examiner

*Primary Examiner*—Thuy Vinh Tran
(74) *Attorney, Agent, or Firm*—Morrison & Foerster LLP

(57) ABSTRACT

A current of the same amount or in a constant ratio is applied to each of a combination of a blue light emitting diode having a small wavelength variation and a green light emitting diode having a large wavelength variation. With this, as an amount of applied current increases, an oscillation wavelength of the green light emitting diode having the large wavelength variation changes from a long wavelength side to a short wavelength side and mixes with a blue color of the blue light emitting diode having the small wavelength variation to gradually change chromaticity as a whole. When desired chromaticity is obtained, the amount of the current is fixed.

19 Claims, 6 Drawing Sheets

| | Blue | Green |
|---|---|---|
| 5mA | 452.4nm | 552.8nm |
| 10mA | 451.6nm | 548.8nm |
| 20mA | 450.8nm | 543.5nm |
| 30mA | 450.5nm | 540.8nm |
| 40mA | 450.0nm | 537.8nm |

LIGHT EMITTING APPARATUS GENERATING WHITE LIGHT BY MIXING OF LIGHT OF A PLURALITY OF OSCILLATION WAVELENGTHS

This nonprovisional application is based on Japanese Patent Application No. 2004-182712 filed with the Japan Patent Office on Jun. 21, 2004, the entire contents of which are hereby incorporated by reference.

BACKGROUND OF THE INVENTION

1. Field of the Invention

The present invention relates to a light emitting apparatus and, more specifically, to a light emitting apparatus generating white light by mixing of light of a plurality of oscillation wavelengths.

2. Description of the Background Art

Studies have been made to develop a white light source of high quality using a light emitting diode (also referred to as an LED). The white light source using a light emitting diode is utilized in, for example, a backlight of a liquid crystal display device, a luminaire or an image reading apparatus.

Methods of generating a white light source with a light emitting diode are broadly divided into a method using a fluorescent material and a method using a plurality of oscillation wavelengths. In the method using a fluorescent material, a fluorescent material is used for converting light ranging from ultraviolet to blue emitted from the light emitting diode into colors such as yellow, green and red to generate a white color. In the method using a plurality of oscillation wavelengths, a plurality of light emitting diodes having two, three or more different oscillation wavelengths are turned on to generate a white color.

With either method, however, it is difficult to actually obtain desired chromaticity and intensity of emitted light.

In the former method using the fluorescent material, brightness of the ultraviolet-to-blue light emitting diode varies and chromaticity largely differs due to variation in application of the fluorescent material. Furthermore, once the white light source using the fluorescent material is manufactured as a product, adjustment of the chromaticity becomes substantially impossible.

The latter method using a plurality of oscillation wavelengths is disclosed, for example, in the following documents.

Japanese Patent Laying-Open No. 2001-272938 discloses a tone adjustment circuit which can correct a variation in tone of each LED by controlling a forward current flowing through a monochromatic LED to control the tone of emitted light, and discloses an LED display device including the circuit.

Japanese Patent Laying-Open No. 2002-324685 discloses a luminaire which can adjust chromaticity and brightness of light for illumination by controlling a level of a current supplied to a light emitting diode and a ratio between ON and OFF times.

Japanese Patent Laying-Open No. 2004-086081 discloses a color display device including a time memory circuit for storing a time of light emission of a plurality of light emitting diodes and a control unit for varying the time of light emission of the light emitting diodes based on stored information of the time memory circuit, in which a white balance of light obtained by light emission of a plurality of light emitting devices is adjusted by rewriting the stored information of the time memory circuit.

Japanese Patent National Publication No. 2002-533870 discloses an LED luminaire emitting white light, which includes a plurality of LEDs for each of red, green and blue colors respectively having separate power supplies, and a photodiode formed to measure light outputs of all of the LEDs.

A conventional tone adjustment circuit disclosed in Japanese Patent Laying-Open No. 2001-272938 will now be described in detail referring to the drawing.

FIG. 12 is a circuit diagram indicating a specific circuit construction of a conventional tone adjustment circuit 100.

Referring to FIG. 12, the conventional tone adjustment circuit 100 includes a light emitting diode 101 using InGaN (indium gallium nitride), a variable resistance 102, a transistor 103, and a pulse width modulation circuit (hereafter referred to as a PWM circuit) 104. Light emitting diode 101, variable resistance 102 and transistor 103 are connected in series between a power supply node Vcc and a ground node. PWM circuit 104 is connected to a base of transistor 103 and applies a driving voltage having a modulated pulse width via the base.

The conventional tone adjustment circuit 100 adjusts a value of a forward current flowing through light emitting diode 101 by adjusting a resistance value of variable resistance 102. With this, a tone of light emitting diode 101 can be adjusted. In addition, the conventional tone adjustment circuit 100 changes a pulse width (a time width) of the forward current with PWM circuit 104 to adjust a duty ratio. With this, luminous intensity of light emitting diode 101 can be adjusted.

As described above, the conventional tone adjustment circuit or the like disclosed in each of the aforementioned documents adjusts an amount of a flowing current for each light emitting device to generate desired chromaticity, and changes a pulse width or a duty ratio of a driving voltage to adjust intensity of emitted light. This is because, in a common light emitting diode, an oscillation wavelength varies when an amount of a current flowing therethrough changes, and consequently chromaticity changes. Therefore, once the chromaticity is determined, generally a current value will not be changed and, alternatively, a lighting time is changed to vary brightness of the light emitting device.

Adjustment of chromaticity alone without that of intensity of emitted light can be performed by changing a ratio of a lighting time of a light emitting diode of each oscillation wavelength. Japanese Patent Laying-Open No. 2001-209049 discloses a luminaire and a liquid crystal display device, each of which has a light emitting diode separately provided for correcting chromaticity, in which intensity of light emitted from the diode is changed with a current value to adjust the chromaticity.

Furthermore, a light emitting diode is devised which has light emitting regions for different wavelengths in one device and mixes oscillation wavelengths thereof to emit white light with one device. Japanese Patent Laying-Open No. 2002-368268 discloses a compound semiconductor light emitting device which has a multiple quantum barrier layer for separating at least two well layers having different light wavelengths to enable emission of a plurality of different light wavelengths within one device to implement emission of white light.

When a plurality of white light sources are aligned to be used as a backlight of a liquid crystal display device or a light source for illumination, even a small difference in chromaticity among the white light sources will give an unnatural impression because human eyes feel a difference in colors relatively large by comparison. Therefore, chromaticity of the white light sources have to be made as even as possible.

In the conventional method of generating white light source using a plurality of oscillation wavelengths, since a current flowing through each light emitting device is controlled independently, independent adjustment means of the same number as that of light emitting devices or oscillation wavelengths are required. Therefore, a whole driving circuit becomes large and complicated, resulting in increased cost. In addition, since adjustment of chromaticity is required for each oscillation wavelength, an adjustment operation becomes complicated.

SUMMARY OF THE INVENTION

An object of the present invention is to provide a light emitting apparatus which does not require independent adjustment means of the same number as that of light emitting devices or oscillation wavelengths and does not require adjustment of chromaticity for every oscillation wavelength.

The present invention is a light emitting apparatus generating white light by mixing of light of a plurality of oscillation wavelengths, which includes a first light emitting device, a second light emitting device having an oscillation wavelength different from that of the first light emitting device, and a power supply node for applying a voltage to the first and second light emitting devices. A value of a current flowing from the power supply node into each of the first and second light emitting devices is gradually changed to adjust chromaticity of mixed light from the first and second light emitting devices to obtain a desired white color.

A voltage value of the power supply node is preferably adjusted to obtain chromaticity of mixed light from the first and second light emitting devices corresponding to a desired white color.

Preferably, the first and second light emitting devices are connected in parallel to the power supply node, and the light emitting apparatus further includes a first variable resistance for adjusting a value of a current flowing through the first light emitting device and a second variable resistance for adjusting a value of a current flowing through the second light emitting device. A resistance value of each of the first and second variable resistances is adjusted to obtain chromaticity of mixed light from the first and second light emitting devices corresponding to a desired white color.

Preferably, the first and second light emitting devices are connected in series to equalize a current flowing through each of the first and second light emitting devices, and the light emitting apparatus further includes a variable resistance for adjusting a value of the current flowing through the first and second light emitting devices. A resistance value of the variable resistance is adjusted to obtain chromaticity of mixed light from the first and second light emitting devices corresponding to a desired white color.

The second light emitting device preferably has a larger variation in wavelength for a variation in amount of a current flowing therethrough as compared with the first light emitting device.

Preferably, the first light emitting device mainly emits blue light and the second light emitting device mainly emits green light.

Preferably, the light emitting apparatus further includes a modulation circuit for adjusting a lighting time of each of the first and second light emitting devices by controlling an ON/OFF state of a current flowing through each of the first and second light emitting devices to obtain desired intensity of mixed light from the first and second light emitting devices.

Preferably, the light emitting apparatus further includes a constant current circuit for supplying a constant current to the first and second light emitting devices, a chromaticity detection and operation unit for performing a comparison of chromaticity of mixed light from the first and second light emitting devices with prescribed chromaticity and outputting a result of the comparison of chromaticity to the constant current circuit, and an average current measurement circuit for performing a comparison of an average value of a current flowing through each of the first and second light emitting devices with a prescribed current value and outputting a result of the comparison of currents to the modulation circuit. The constant current circuit receives the result of the comparison of chromaticity and increases a current supplied to each of the first and second light emitting devices from zero until the chromaticity of mixed light from the first and second light emitting devices coincides with the prescribed chromaticity. The modulation circuit receives the result of the comparison of currents and adjusts a lighting time of each of the first and second light emitting devices to match the average value of the current flowing through each of the first and second light emitting devices with the prescribed current value.

The chromaticity detection and operation unit preferably includes a first filter for transmitting light from the first light emitting device in mixed light from the first and second light emitting devices, a second filter for transmitting light from the second light emitting device in mixed light from the first and second light emitting devices, a first photoelectric conversion device for converting light from the first light emitting device transmitted through the first filter into a current, a second photoelectric conversion device for converting light from the second light emitting device transmitted through the second filter into a current, a first current-voltage conversion amplifier for converting a current output from the first photoelectric conversion device into a voltage and amplifying the voltage, a second current-voltage conversion amplifier for converting a current output from the second photoelectric conversion device into a voltage and amplifying the voltage, and an operation circuit for receiving a voltage output from each of the first and second current-voltage conversion amplifiers, performing a comparison of the voltage with the prescribed chromaticity, and outputting a result of the comparison of chromaticity to the constant current circuit.

Preferably, the light emitting apparatus further includes a third light emitting device for emitting a complementary color of mixed light from the first and second light emitting devices.

The light emitting device is preferably a light emitting diode.

According to another aspect of the present invention, a light emitting apparatus generating white light by mixing of light of a plurality of oscillation wavelengths includes a light emitting device for emitting light of a plurality of different oscillation wavelengths, and a power supply node for applying a voltage to the light emitting device. A value of a current flowing from the power supply node into the light emitting device is gradually changed to adjust chromaticity of mixed light resulting from a plurality of different wavelengths of the light emitting device to obtain a desired white color.

A voltage value of the power supply node is preferably adjusted to obtain chromaticity of mixed light resulting from the plurality of different wavelengths of the light emitting device corresponding to a desired white color.

Preferably, the light emitting apparatus further includes a variable resistance for adjusting a value of a current flowing through the light emitting device. A resistance value of the variable resistance is adjusted to obtain chromaticity of mixed light resulting from the plurality of different wavelengths of the light emitting device corresponding to a desired white color.

A second oscillation wavelength of the light emitting device preferably has a larger variation for a variation in amount of a current flowing therethrough as compared with a first oscillation wavelength of the light emitting device.

Preferably, the first oscillation wavelength mainly corresponds to a blue color and the second oscillation wavelength mainly corresponds to a green color.

Preferably, the light emitting apparatus further includes a modulation circuit for adjusting a lighting time of the light emitting device by controlling an ON/OFF state of a current flowing through the light emitting device to obtain desired intensity of mixed light resulting from the plurality of different wavelengths of the light emitting device.

Preferably, the light emitting apparatus further includes a constant current circuit for supplying a constant current to the light emitting device, a chromaticity detection and operation unit for performing a comparison of chromaticity of mixed light resulting from the plurality of different wavelengths of the light emitting device with prescribed chromaticity and outputting a result of the comparison of chromaticity to the constant current circuit, and an average current measurement circuit for performing a comparison of an average value of a current flowing through the light emitting device with a prescribed current value and outputting a result of the comparison of currents to the modulation circuit. The constant current circuit receives the result of the comparison of chromaticity and increases a current supplied to the light emitting device from zero until the chromaticity of mixed light resulting from the plurality of different wavelengths of the light emitting device coincides with the prescribed chromaticity. The modulation circuit receives the result of the comparison of currents and adjusts a lighting time of the light emitting device to match the average value of the current flowing through the light emitting device with the prescribed current value.

The chromaticity detection and operation unit preferably includes a first filter for transmitting light of the first oscillation wavelength in mixed light resulting from the plurality of different wavelengths of the light emitting device, a second filter for transmitting light of the second oscillation wavelength in mixed light resulting from the plurality of different wavelengths of the light emitting device, a first photoelectric conversion device for converting light of the first oscillation wavelength transmitted through the first filter into a current, a second photoelectric conversion device for converting light of the second oscillation wavelength transmitted through the second filter into a current, a first current-voltage conversion amplifier for converting a current output from the first photoelectric conversion device into a voltage and amplifying the voltage, a second current-voltage conversion amplifier for converting a current output from the second photoelectric conversion device into a voltage and amplifying the voltage, and an operation circuit for receiving a voltage output from each of the first and second current-voltage conversion amplifiers, performing a comparison of the voltage with the prescribed chromaticity, and outputting a result of the comparison of chromaticity to the constant current circuit.

Preferably, the light emitting device also emits light of a third oscillation wavelength corresponding to a complementary color of mixed light resulting from the first and second oscillation wavelengths.

The light emitting device is preferably a light emitting diode.

According to the present invention, independent adjustment means of the same number as that of light emitting devices or oscillation wavelengths are not required and adjustment of chromaticity for every oscillation wavelength is also not required.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
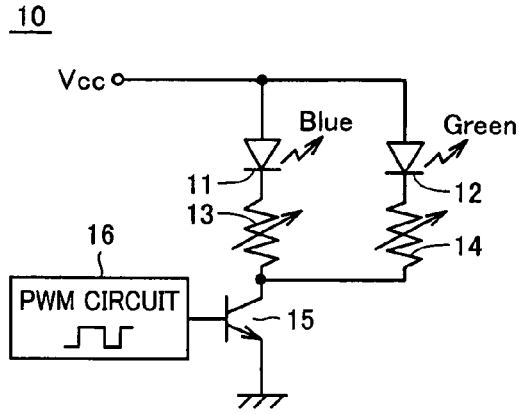
FIG. 1 is a circuit diagram indicating a circuit construction of a light emitting apparatus 10 according to a first embodiment of the present invention.

Embodiments of the present invention will now be described in detail referring to the drawings. The same or corresponding portions in the drawings are indicated with the same characters, and descriptions thereof will not be repeated.

First Embodiment

Referring to FIG. 1, a light emitting apparatus 10 of a first embodiment includes a blue light emitting diode 11, a green light emitting diode 12, variable resistances 13, 14, a transistor 15, and a PWM circuit 16. Blue light emitting diode 11, variable resistance 13 and transistor 15 are connected in series between a power supply node Vcc and a ground node. Green light emitting diode 12 and variable resistance 14 are connected in series between power supply node Vcc and a collector of transistor 15. PWM circuit 16 is connected to a base of transistor 15 and applies a driving voltage having a modulated pulse width to the base.

Transistor 15 is turned ON/OFF corresponding to the HIGH level/LOW level of the driving voltage applied by PWM circuit 16. Therefore, a lighting time of blue light emitting diode 11 and green light emitting diode 12 can be controlled by adjusting the pulse width of the driving voltage applied from PWM circuit 16.

Figure 2:
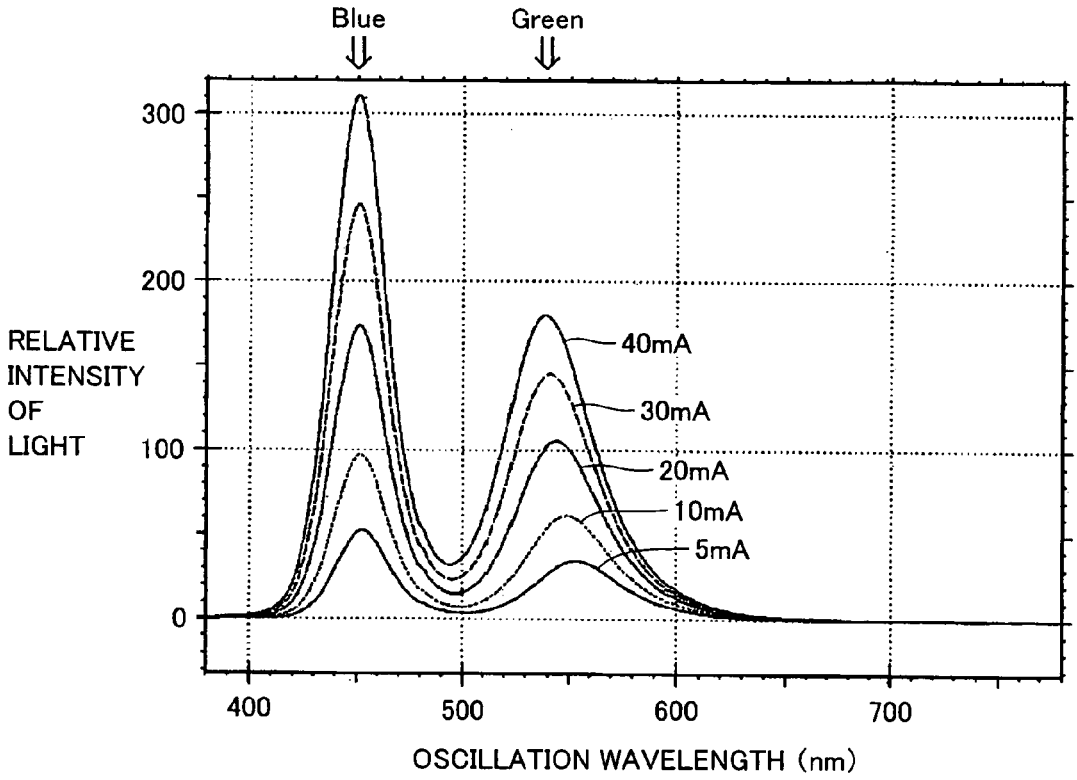
FIG. 2 is a graph of variations in relative intensity of light for each amount of a current due to a difference in oscillation wavelengths of a blue light emitting diode 11 and a green light emitting diode 12.
Figures 3, 4:
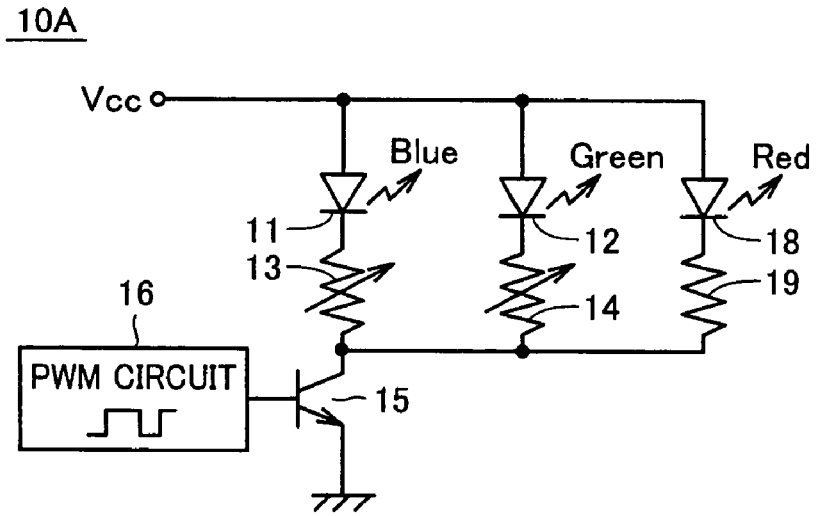
FIG. 3 shows with values variations in oscillation wavelengths of blue light emitting diode 11 and green light emitting diode 12 corresponding to amounts of the current.
FIG. 4 is a circuit diagram indicating a circuit construction of a light emitting apparatus 10A which is a modified example of light emitting apparatus 10 according to the first embodiment of the present invention.

FIG. 2 is a graph of variations in relative intensity of light for each amount of a current due to a difference in oscillation wavelengths of blue light emitting diode 11 and green light emitting diode 12. FIG. 3 shows with values, variations in oscillation wavelengths of blue light emitting diode 11 and green light emitting diode 12 corresponding to amounts of the current. In FIG. 2, graphs for blue light emitting diode 11 and green light emitting diode 12 are represented with continuous curves for convenience of measurement.

As shown in FIGS. 2 and 3, blue light emitting diode 11 has an oscillation wavelength of 452.4 nm when a current amount is 5 mA, which oscillation wavelength decreases by a small amount as the current amount increases and becomes 450.0 nm when the current amount is 40 mA. Green light emitting diode 12 has an oscillation wavelength of 552.8 nm when the current amount is 5 mA, which oscillation wavelength decreases by a large amount as the current amount increases and becomes 537.8 nm when the current amount is 40 mA.

As described above, while blue light emitting diode 11 has a small variation in wavelength for a variation in current amount, green light emitting diode 12 has a large variation in wavelength for a variation in current amount. This is mainly caused by a difference in materials or ratios of materials for the blue light emitting diode and the green light emitting diode, which results in a difference in ratios of variations in energy levels relating to light emission.

Light emitting apparatus 10 of the first embodiment shown in FIG. 1 has a construction in which blue light emitting diode 11, having a small variation in wavelength for a variation in current amount, is connected in parallel to green light emitting diode 12 having a large variation in wavelength for a variation in current amount. Green light emitting diode 12 may also be an yellow-green, yellow or orange light emitting diode as long as it is a diode having a large variation in wavelength.

Chromaticity of blue light emitting diode 11 is adjusted by changing a resistance value of variable resistance 13 to change the current amount. Chromaticity of green light emitting diode 12 is adjusted by changing a resistance value of variable resistance 14 to change the current amount. It is to be noted that, the amount of the current flowing through each of blue light emitting diode 11 and green light emitting diode 12 can also be changed by making power supply voltage Vcc variable. On the other hand, intensity of emitted light of blue light emitting diode 11 and green light emitting diode 12 is adjusted by changing the pulse width of the driving voltage applied to the base of transistor 15.

In light emitting apparatus 10 according to the first embodiment of the present invention, desired chromaticity is generated with a combination of light emitting devices respectively having large and small variations in wavelengths for a variation in amount of a current flowing therethrough while the current of the same amount or in a constant ratio is applied to each light emitting device, in contrast to a conventional technique in which desired chromaticity is generated by adjusting an amount of a flowing current for each light emitting device.

More specifically, the current of the same amount or in a constant ratio is applied to each of the combination of blue light emitting diode 11 having a small wavelength variation and green light emitting diode 12 having a large wavelength variation. With this, as an amount of applied current increases, the oscillation wavelength of green light emitting diode 12 having the large wavelength variation changes from a long wavelength side to a short wavelength side, and mixes with a blue color of blue light emitting diode 11 having the small wavelength variation to gradually change chromaticity as a whole. When desired chromaticity is obtained, the amount of the current is fixed.

As described above, since there is no need to provide a control circuit for each of a plurality of light emitting devices because chromaticity is adjusted with the combination of light emitting devices respectively having large and small variations in wavelengths for a variation in amount of a current while the current of the same amount or in a constant ratio is applied to each light emitting device, a small light emitting apparatus can be obtained with a substantially low cost, and an arrangement in a high density is also allowed. It is to be noted that, intensity of emitted light is adjusted by adjusting a pulse width of the driving voltage applied from PWM circuit 16 to the base of transistor 15 to change a lighting time of blue light emitting diode 11 and green light emitting diode 12.

In light emitting apparatus 10 of the first embodiment, variable resistances 13, 14 are provided respectively for blue light emitting diode 11 and green light emitting diode 12. Therefore, a white light source of high quality can be obtained efficiently by adjusting respective resistant values of variable resistances 13, 14 beforehand to obtain a mixing ratio of a blue color of blue light emitting diode 11 and a green color of green light emitting diode 12 nearly corresponding to a desired white color and, thereafter, finally adjusting an amount of the current flowing through each of blue light emitting diode 11 and green light emitting diode 12 with PWM circuit 16.

Though the white light source obtained with a combination of a blue light source and a green light source is sufficient in a practical aspect, it is not an ideal white light source since a resulting white color is somewhat bluish because of lack of a red light source as one of the primary colors of light. Therefore, a light emitting apparatus having the red light source in addition to light emitting apparatus 10 shown in FIG. 1 will now be described.

FIG. 4 is a circuit diagram indicating a circuit construction of a light emitting apparatus 10A which is a modified example of light emitting apparatus 10 according to the first embodiment of the present invention.

Referring to FIG. 4, light emitting apparatus 10A has a construction in which a red light emitting diode 18 and a fixed resistance 19 are added to light emitting apparatus 10 shown in FIG. 1. Red light emitting diode 18 and fixed resistance 19 are connected in series between power supply node Vcc and the collector of transistor 15. Red light emitting diode 18 is connected in parallel to blue light emitting diode 11 and green light emitting diode 12.

In light emitting apparatus 10A as described above, white light generated with light emitting apparatus 10 of FIG. 1 can be made nearer to an ideal white color by letting red light emitting diode 18 emit light with a constant current and changing the amount of the current flowing through each of blue light emitting diode 11 and green light emitting diode 12 to adjust chromaticity.

As described above, according to the first embodiment, since the combination of light emitting devices respectively having large and small variations in wavelengths for a variation in amount of a flowing current is used and an amount of a current is adjusted while the current of the same amount or in a constant ratio is applied to each light emitting device, independent adjustment means of the same number as that of light emitting devices or oscillation wavelengths are not required, and adjustment of chromaticity for every oscillation wavelength is also not required.

Second Embodiment

In each of light emitting apparatuses 10 and 10A of the first embodiment, blue light emitting diode 11 having a small variation in wavelength for a variation in current amount is connected in parallel to green light emitting diode 12 having a large variation in wavelength for a variation in current amount. Therefore, respective variable resistances 13, 14 are required for blue light emitting diode 11 and green light emitting diode 12.

Though providing of individual variable resistances 13, 14 has an advantage such that the amount of the current flowing through each of blue light emitting diode 11 and green light emitting diode 12 can be individually set beforehand, it requires an adjustment operation for each variable resistance and, furthermore, an area of a circuit increases according to a number of variable resistances. Therefore, in a second embodiment, light emitting apparatuses 20 and 20A which overcame such problems are described in detail.

Figure 5:
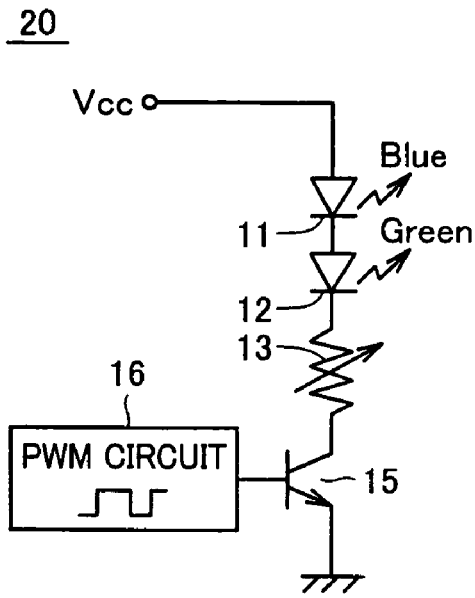
FIG. 5 is a circuit diagram indicating a circuit construction of a light emitting apparatus 20 according to a second embodiment of the present invention.

Referring to FIG. 5, light emitting apparatus 20 of the second embodiment includes blue light emitting diode 11, green light emitting diode 12, variable resistance 13, transistor 15, and PWM circuit 16. Blue light emitting diode 11, green light emitting diode 12, variable resistance 13, and transistor 15 are connected in series between power supply node Vcc and the ground node. PWM circuit 16 is connected to the base of transistor 15 and applies a driving voltage having a modulated pulse width to the base.

Light emitting apparatus 20 of the second embodiment is different from light emitting apparatus 10 of the first embodiment in that, blue light emitting diode 11 and green light emitting diode 12 are connected in series. With this, the current flowing through blue light emitting diode 11 and the current flowing through green light emitting diode 12 can be equalized with a simple circuit construction.

As an amount of the current flowing through blue light emitting diode 11 and green light emitting diode 12 increases, the oscillation wavelength of green light emitting diode 12 having the large wavelength variation changes from a long wavelength side to a short wavelength side and mixes with a blue color of blue light emitting diode 11 having the small wavelength variation to gradually change chromaticity as a whole. When desired chromaticity is obtained, the amount of the current is fixed.

As described above, since a plurality of light emitting devices are connected in series to equalize the current flowing therethrough and chromaticity is adjusted with the combination of light emitting devices respectively having large and small variations in wavelengths for a variation in amount of the current, there is no need to provide a control circuit for each of a plurality of light emitting devices and only one variable resistance is required. Therefore, a smaller light emitting apparatus can be obtained with a lower cost as compared with the first embodiment, and an arrangement in a further high density is also allowed.

Figure 6:
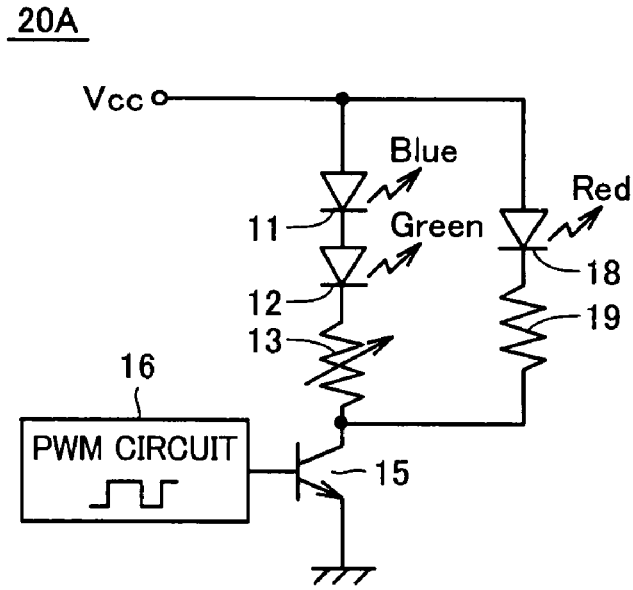
FIG. 6 is a circuit diagram indicating a circuit construction of a light emitting apparatus 20A which is a modified example of light emitting apparatus 20 according to the second embodiment of the present invention.

FIG. 6 is a circuit diagram indicating a circuit construction of light emitting apparatus 20A which is a modified example of light emitting apparatus 20 according to the second embodiment of the present invention.

Referring to FIG. 6, light emitting apparatus 20A has a construction in which red light emitting diode 18 and fixed resistance 19 are added to light emitting apparatus 20 shown in FIG. 5. Red light emitting diode 18 and fixed resistance 19 are connected in series between power supply node Vcc and the collector of transistor 15. Red light emitting diode 18 is connected in parallel to blue light emitting diode 11 and green light emitting diode 12 which are connected in series.

In light emitting apparatus 20A as described above, white light generated with light emitting apparatus 20 of FIG. 5 can be made nearer to an ideal white color by letting red light emitting diode 18 emit light with a constant current and changing the amount of the current flowing through blue light emitting diode 11 and green light emitting diode 12 to adjust chromaticity.

As described above, according to the second embodiment, since a plurality of light emitting devices are connected in series to equalize a current flowing therethrough and an amount of the current is adjusted with the combination of light emitting devices respectively having large and small variations in wavelengths for a variation in amount of a current flowing therethrough, independent adjustment means of the same number as that of light emitting devices or oscillation wavelengths are not required, and adjustment of chromaticity for every oscillation wavelength is also not required.

Third Embodiment

In each of light emitting apparatuses 10, 20 of the first and second embodiments, blue light emitting diode 11 having a small variation in wavelength for a variation in current amount is combined with green light emitting diode 12 having a large variation in wavelength for a variation in current amount.

Though use of blue light emitting diode 11 and green light emitting diode 12 separately is advantageous in terms of cost because each diode is generally inexpensive, an area of a circuit increases according to a number of light emitting diodes. Therefore, in a third embodiment, light emitting apparatuses 30 and 30A which overcame such problem are described in detail.

Figure 7:
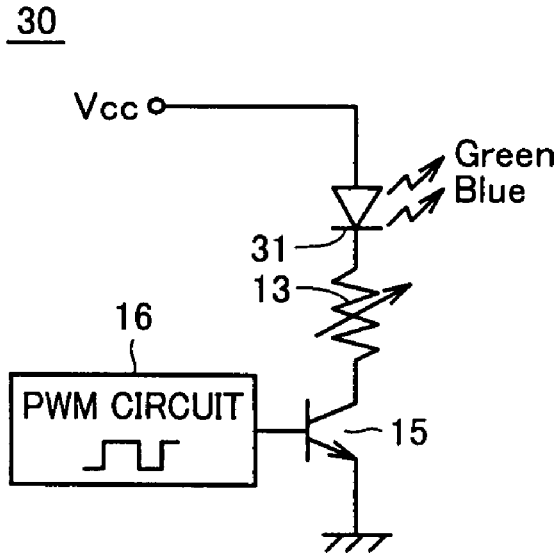
FIG. 7 is a circuit diagram indicating a circuit construction of a light emitting apparatus 30 according to a third embodiment of the present invention.

Referring to FIG. 7, light emitting apparatus 30 of the third embodiment includes a light emitting diode 31 oscillating a plurality of wavelengths, variable resistance 13, transistor 15, and PWM circuit 16. Light emitting diode 31 oscillating a plurality of wavelengths, variable resistance 13 and transistor 15 are connected in series between power supply node Vcc and the ground node. PWM circuit 16 is connected to the base of transistor 15 and applies a driving voltage having a modulated pulse width to the base.

Figure 8:
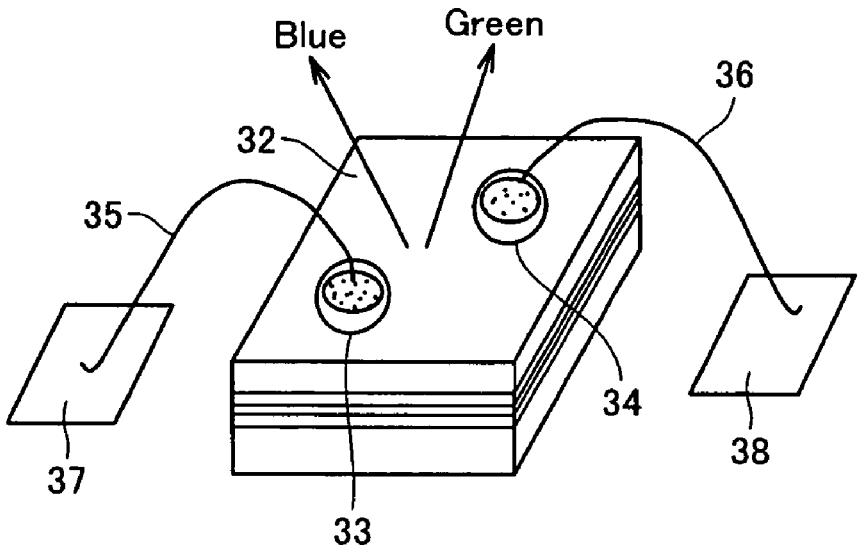
FIG. 8 schematically shows an example of a device structure of a light emitting diode 31 oscillating a plurality of wavelengths.

FIG. 8 schematically shows an example of a device structure of light emitting diode 31 oscillating a plurality of wavelengths.

Referring to FIG. 8, light emitting diode 31 oscillating a plurality of wavelengths includes a light emitting diode chip 32, wires 35, 36, and external electrodes 37, 38. Wires 35, 36 are made of, for example, Au (gold). Light emitting diode chip 32 has a semiconductor multilayer structure and includes internal electrodes 33, 34. With application of voltages from external electrodes 37, 38 to internal electrodes 33, 34 via wires 35, 36 respectively, light emitting diode chip 32 emits light of a plurality of different wavelengths corresponding to blue and green colors which are mixed to generate white light.

Light emitting apparatus 30 of the third embodiment shown in FIG. 7 is different from light emitting apparatuses 10, 20 of the first and second embodiments in that, blue light emitting diode 11 and green light emitting diode 12 are replaced with one light emitting diode 31 emitting light of a plurality of different oscillation wavelengths. With this, light of a plurality of wavelengths can be emitted with one light emitting diode.

As an amount of the current flowing through light emitting diode 31 oscillating a plurality of wavelengths increases, the oscillation wavelength corresponding to a green color having the large wavelength variation changes from a long wavelength side to a short wavelength side and mixes with a blue color having the small wavelength variation to gradually change chromaticity as a whole. When desired chromaticity is obtained, the amount of the current is fixed.

As described above, since chromaticity is adjusted by gradually changing an amount of a current flowing through one light emitting device emitting light of a plurality of different oscillation wavelengths, only one light emitting device and only one variable resistance are required. Therefore, a smaller light emitting apparatus can be obtained as compared with the second embodiment, and an arrangement in a further high density is also allowed.

Figure 9:
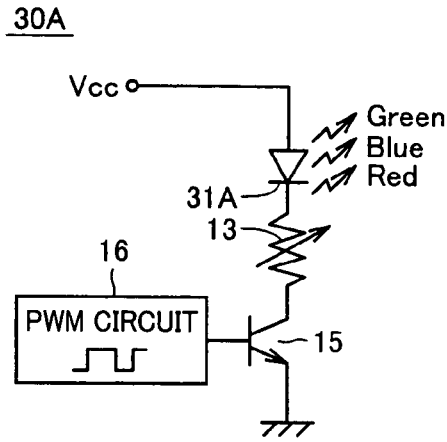
FIG. 9 is a circuit diagram indicating a circuit construction of a light emitting apparatus 30A which is a modified example of light emitting apparatus 30 according to the third embodiment of the present invention.

FIG. 9 is a circuit diagram indicating a circuit construction of light emitting apparatus 30A which is a modified example of light emitting apparatus 30 according to the third embodiment of the present invention.

Referring to FIG. 9, light emitting apparatus 30A is different from light emitting apparatus 30 shown in FIG. 7 in that, light emitting diode 31 emitting light of two colors of blue and green is replaced with light emitting diode 31A emitting light of three colors of blue, green and red.

In light emitting apparatus 30A as described above, white light generated with light emitting apparatus 30 of FIG. 7 can be made nearer to an ideal white color by changing the amount of the current flowing through light emitting diode 31 oscillating a plurality of wavelengths to adjust chromaticity with an appropriate balance of blue, green and red colors emitted.

As described above, according to the third embodiment, since an amount of a current flowing through one light emitting device emitting light of a plurality of different oscillation wavelengths is gradually changed to adjust chromaticity, independent adjustment means of the same number as that of light emitting devices or oscillation wavelengths are not required, and adjustment of chromaticity for every oscillation wavelength is also not required.

Fourth Embodiment

In a fourth embodiment, a light emitting apparatus 40 is described which has, in addition to each of light emitting apparatuses 10, 20 and 30 of the first to third embodiments, a function of monitoring chromaticity and intensity of light emitted from a light emitting diode and feeding back the result. Though an example having the function added to light emitting apparatuses 20 of the second embodiment will be described in the following, the function can be similarly added to light emitting apparatuses 10, 30 of the first and third embodiments.

Figure 10:
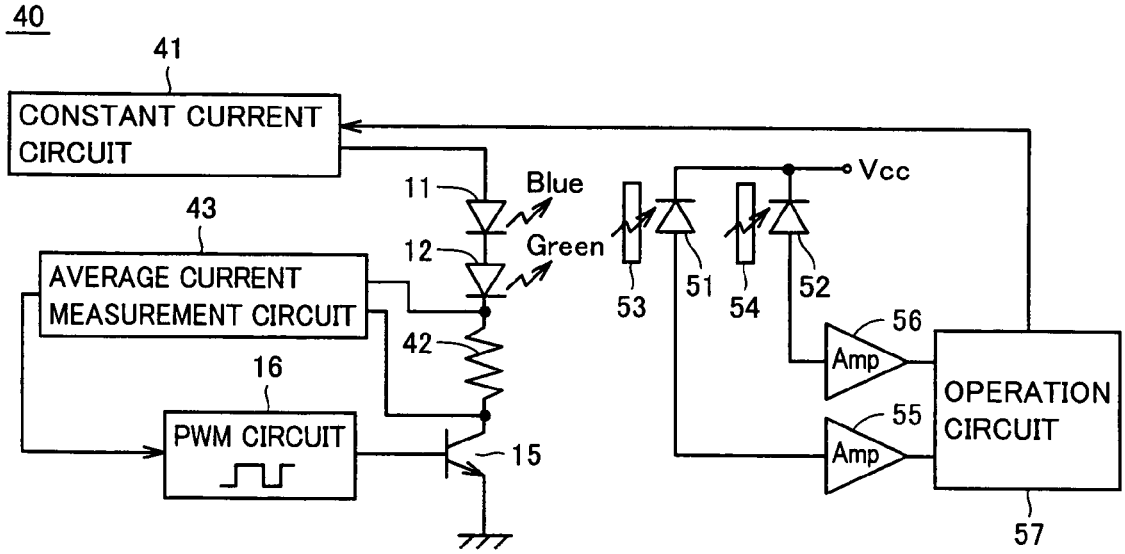
FIG. 10 is a circuit diagram indicating a circuit construction of a light emitting apparatus 40 according to a fourth embodiment of the present invention.

Referring to FIG. 10, light emitting apparatus 40 of the fourth embodiment includes blue light emitting diode 11, green light emitting diode 12, a constant current circuit 41, a resistance for current detection 42, an average current measurement circuit 43, transistor 15, PWM circuit 16, photodiodes for light detection 51, 52, a filter for transmission of a blue spectrum 53, a filter for transmission of a green spectrum 54, current-voltage conversion amplifiers 55, 56, and an operation circuit 57.

Blue light emitting diode 11, green light emitting diode 12, resistance for current detection 42, and transistor 15 are connected in series between constant current circuit 41 and the ground node. Constant current circuit 41 supplies a constant current to blue light emitting diode 11 and green light emitting diode 12. Average current measurement circuit 43 detects an average current value from a value of a current flowing through resistance for current detection 42 and a degree of pulse modulation and outputs the value to PWM circuit 16. PWM circuit 16 is connected to the base of transistor 15 and applies to the base a driving voltage having a modified pulse width corresponding to the average current value output from average current measurement circuit 43.

Filter for transmission of a blue spectrum 53 only transmits blue light in light emitted from blue light emitting diode 11 and green light emitting diode 12. Photodiode for light detection 51 is connected to power supply node Vcc and converts the blue light transmitted through filter for transmission of a blue spectrum 53 into a current. Filter for transmission of a green spectrum 54 only transmits green light in light emitted from blue light emitting diode 11 and green light emitting diode 12. Photodiode for light detection 52 is connected to power supply node Vcc and converts the green light transmitted through filter for transmission of a green spectrum 54 into a current.

Current-voltage conversion amplifier 55 converts a current output from photodiode for light detection 51 into a voltage and amplifies the voltage. Current-voltage conversion amplifier 56 converts a current output from photodiode for light detection 52 into a voltage and amplifies the voltage. Operation circuit 57 receives a voltage output from each of current-voltage conversion amplifiers 55, 56, performs an operation of a difference between the voltage and a set value of chromaticity of each of blue light emitting diode 11 and green light emitting diode 12 which is set beforehand, and outputs the result to constant current circuit 41.

Operations of light emitting apparatus 40 will now be described.

First, a current value output from constant current circuit 41 to blue light emitting diode 11 and green light emitting diode 12 is gradually increased from 0. For each time the current value is increased, operation circuit 57 performs a comparison operation between a voltage value output from each of current-voltage conversion amplifiers 55, 56 and the set value of chromaticity of each of blue light emitting diode 11 and green light emitting diode 12 which is set beforehand, and outputs the result to constant current circuit 41.

Constant current circuit 41 continuously increases the current value output to blue light emitting diode 11 and green light emitting diode 12 until the result of the comparison output from operation circuit 57 shows correspondence. When the result of the comparison output from operation circuit 57 shows correspondence, that is, when blue light emitting diode 11 and green light emitting diode 12 attain desired chromaticity, the current value output from constant current circuit 41 stops increasing, and blue light emitting diode 11 and green light emitting diode 12 are driven with that current value.

Average current measurement circuit 43 continuously detects an average current value from a value of a current flowing through resistance for current detection 42 and a degree of pulse modulation either before or after the current value output from constant current circuit 41 is fixed, and outputs the result to PWM circuit 16. PWM circuit 16 modulates a pulse width of a driving voltage to match the average current value with a previously set current value, and applies a resulting voltage to the base of transistor 15. With this, a lighting time is controlled to obtain a desired value of the average current value flowing through blue light emitting diode 11 and green light emitting diode 12. As a result, desired intensity of emitted light can be obtained.

It is to be noted that, a ratio of wavelength spectrums of blue light emitting diode 11 and green light emitting diode 12 is used for a calculation of chromaticity in operation circuit 57. Therefore, operation circuit 57 calculates chromaticity without an effect of a variation in amount of light due to PWM circuit 16 and independently of pulse width modulation of the driving voltage for obtaining desired intensity of emitted light.

Figure 11:
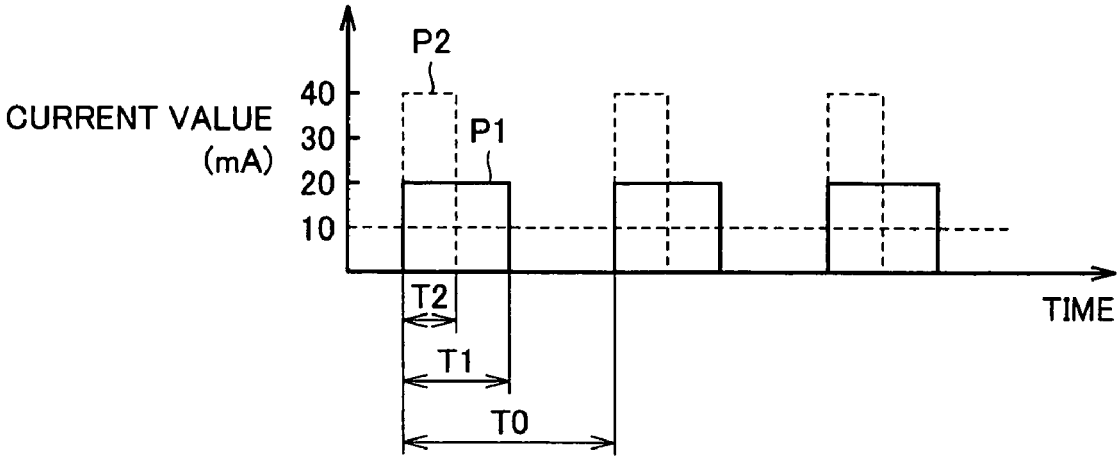
FIG. 11 shows variations of a current flowing through blue light emitting diode 11 and green light emitting diode 12 according to controls from a constant current circuit 41 and a PWM circuit 16.
Figure 12:
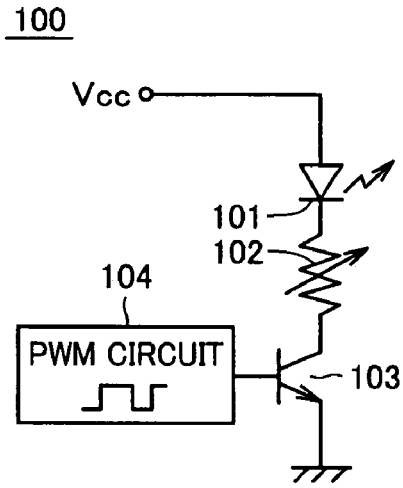
FIG.12 PRIOR ART
FIG. 12 is a circuit diagram indicating a specific circuit construction of a conventional tone adjustment circuit 100.

FIG. 11 shows variations of the current flowing through blue light emitting diode 11 and green light emitting diode 12 according to controls from constant current circuit 41 and PWM circuit 16.

Referring to FIG. 11, it is assumed that the average current value corresponding to desired intensity of emitted light is 10 mA. When the current value corresponding to desired chromaticity is 20 mA, the current flowing through blue light emitting diode 11 and green light emitting diode 12 is indicated as P1. That is, constant current circuit 41 controls the current which flows during an ON time to be 20 mA, and PWM circuit 16 controls a pulse width T1 of the current to set a duty ratio of the current to 0.5 (T1/T0).

When the current value corresponding to desired chromaticity is 40 mA, the current flowing through blue light emitting diode 11 and green light emitting diode 12 is indicated as P2. That is, constant current circuit 41 controls the current which flows during the ON time to be 40 mA, and PWM circuit 16 controls a pulse width T2 of the current to set a duty ratio of the current to 0.25 (T2/T0).

As described above, according to the fourth embodiment, by adding the function of adjusting a value of a current which flows during an ON time of the light emitting diode to set chromaticity and then changing a duty ratio of the current to adjust intensity of emitted light, chromaticity and intensity of emitted light of the light emitting diode in each of the first to third embodiments can be set as desired.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A light emitting apparatus generating white light by mixing of light of a plurality of oscillation wavelengths, comprising:

a first light emitting device;

a second light emitting device having an oscillation wavelength different from that of said first light emitting device;

a power supply node for applying a voltage to said first light emitting device and said second light emitting device; and a modulation circuit for adjusting a lighting time of each of said first light emitting device and said second light emitting device by controlling an ON/OFF state of a current flowing through each of said first light emitting device and said second light emitting device to obtain desired intensity of mixed light from said first light emitting device and said second light emitting device;

wherein a value of a current flowing from said power supply node into each of said first light emitting device and said second light emitting device is gradually changed to adjust chromaticity of mixed light from said first light emitting device and said second light emitting device to obtain a desired white color.

2. The light emitting apparatus according to claim 1, wherein a voltage value of said power supply node is adjusted to obtain chromaticity of mixed light from said first light emitting device and said second light emitting device corresponding to a desired white color.

3. The light emitting apparatus according to claim 1, wherein said first light emitting device and said second light emitting device are connected in parallel to said power supply node; said light emitting apparatus further comprising:

a first variable resistance for adjusting a value of a current flowing through said first light emitting device; and a second variable resistance for adjusting a value of a current flowing through said second light emitting device; wherein a resistance value of each of said first variable resistance and said second variable resistance is adjusted to obtain chromaticity of mixed light from said first light emitting device and said second light emitting device corresponding to the desired white color.

4. The light emitting apparatus according to claim 1, wherein said first light emitting device and said second light emitting device are connected in series to equalize a current flowing through each of said first light emitting device and said second light emitting device; said light emitting apparatus further comprising:

a variable resistance for adjusting a value of the current flowing through said first light emitting device and said second light emitting device; wherein a resistance value of said variable resistance is adjusted to obtain chromaticity of mixed light from said first light emitting device and said second light emitting device corresponding to the desired white color.

5. The light emitting apparatus according to claim 1, wherein said second light emitting device has a larger variation in wavelength for a variation in amount of a current flowing therethrough as compared with said first light emitting device.

6. The light emitting apparatus according to claim 5, wherein said first light emitting device mainly emits blue light and said second light emitting device mainly emits green light.

7. The light emitting apparatus according to claim 1, further comprising:

a constant current circuit for supplying a constant current to said first light emitting device and said second light emitting device;

a chromaticity detection and operation unit for performing a comparison of chromaticity of mixed light from said first light emitting device and said second light emitting device with prescribed chromaticity and outputting a result of the comparison of chromaticity to said constant current circuit; and an average current measurement circuit for performing a comparison of an average value of a current flowing through each of said first light emitting device and said second light emitting device with a prescribed current value and outputting a result of the comparison of currents to said modulation circuit; wherein said constant current circuit receives said result of the comparison of chromaticity and increases a current supplied to each of said first light emitting device and said second light emitting device from zero until the chromaticity of mixed light from said first light emitting device and said second light emitting device coincides with said prescribed chromaticity, and said modulation circuit receives said result of the comparison of currents and adjusts a lighting time of each of said first light emitting device and said second light emitting device to match the avenge value of the current flowing through each of said first light emitting device and said second light emitting device with said prescribed current value.

8. The light emitting apparatus according to claim 7, wherein said chromaticity detection and operation unit includes a first filter for transmitting light from said first light emitting device in mixed light from said first light emitting device and said second light emitting device, a second filter for transmitting light from said second light emitting device in mixed light from said first light emitting device and said second light emitting device, a first photoelectric conversion device for converting light from said first light emitting device transmitted through said first filter into a current, a second photoelectric conversion device for converting light from said second light emitting device transmitted through said second filter into a current, a first current-voltage conversion amplifier for converting a current output from said first photoelectric conversion device into a voltage and amplifying the voltage;

a second current-voltage conversion amplifier for converting a current output from said second photoelectric conversion device into a voltage and amplifying the voltage; and an operation circuit for receiving a voltage output from each of said first current-voltage conversion amplifier and said second current-voltage conversion amplifier, performing a comparison of the voltage with said prescribed chromaticity, and outputting a result of the comparison of chromaticity to said constant current circuit.

9. The light emitting apparatus according to claim 1, further comprising a third light emitting device for emitting a complementary color of mixed light from said first light emitting device and said second light emitting device.

10. The light emitting apparatus according to claim 1, wherein each of said light emitting devices is a light emitting diode.

11. A light emitting apparatus generating white light by mixing of light of a plurality of oscillation wavelengths, comprising:

a light emitting device for emitting light of a plurality of different oscillation wavelengths;

a power supply node far applying a voltage to said light emitting device; and a variable resistance for adjusting a value of a current flowing through said light emitting device;

wherein a value of a current flowing from said power supply node into said light emitting device is gradually changed to adjust chromaticity of mixed light resulting from the plurality of different oscillation wavelengths of said light emitting device to obtain a desired white color; and wherein a resistance value of said variable resistance is adjusted to obtain chromaticity of mixed light resulting from the plurality of different wavelengths of said light emitting device corresponding to the desired white color.

12. The light emitting apparatus according to claim 11, wherein a voltage value of said power supply node is adjusted to obtain chromaticity of mixed light resulting from the plurality of different oscillation wavelengths of said light emitting device corresponding to a desired white color.

13. The light emitting apparatus according to claim 11, wherein a second oscillation wavelength of said light emitting device has a larger variation for a variation in amount of a current flowing therethrough as compared wit a first oscillation wavelength of said light emitting device.

14. The light emitting apparatus according to claim 13, wherein said first oscillation wavelength mainly corresponds to a blue color and said second oscillation wavelength mainly corresponds to a green color.

15. The light emitting apparatus according to claim 11, further comprising a modulation circuit for adjusting a lighting time of said light emitting device by controlling an ON/OFF state of a current flowing through said light emitting device to obtain desired intensity of mixed light resulting from the plurality of different wavelengths of said light emitting device.

16. The light emitting apparatus according to claim 15, further comprising:

a constant current circuit for supplying a constant current to said light emitting device;

a chromaticity detection and operation unit for performing a comparison of chromaticity of mixed light resulting from the plurality of different wavelengths of said light emitting device with prescribed chromaticity and outputting a result of the comparison of chromaticity to said constant current circuit; and an average current measurement circuit for performing a comparison of an average value of a current flowing through said light emitting device with a prescribed current value and outputting a result of the comparison of currents to said modulation circuit; wherein said constant current circuit receives said result of the comparison of chromaticity and increases a current supplied to said light emitting device from zero until the chromaticity of mixed light resulting from the plurality of different wavelengths of said light emitting device coincides with said prescribed chromaticity, and said modulation circuit receives said result of the comparison of currents and adjusts a lighting time of said light emitting device to match the average value of the current flowing through said light emitting device with said prescribed current value.

17. The light emitting apparatus according to claim 16, wherein said chromaticity detection and operation unit includes a first filter for transmitting light of said first oscillation wavelength in mixed light resulting from the plurality of different wavelengths of said light emitting device, a second filter for transmitting light of said second oscillation wavelength in mixed light resulting from the plurality of different wavelengths of said light emitting device, a first photoelectric conversion device for converting light of said first oscillation wavelength transmitted through said first filter into a current, a second photoelectric conversion device for converting light of said second oscillation wavelength transmitted through said second filter into a current, a first current-voltage conversion amplifier for converting a current output from said first photoelectric conversion device into a voltage and amplifying the voltage, a second current-voltage conversion amplifier for converting a current output from said second photoelectric conversion device into a voltage and amplifying the voltage, and an operation circuit for receiving a voltage output from each of said first current-voltage conversion amplifier and said second current-voltage conversion amplifier, performing a comparison of the voltage with said prescribed chromaticity, and outputting a result of the comparison of chromaticity to said constant current circuit.

18. The light emitting apparatus according to claim 11, wherein said light emitting device also emits light of a third oscillation wavelength corresponding to a complementary color of mixed light resulting from said first oscillation wavelength and said second oscillation wavelength.

19. The light emitting apparatus according to claim 11, wherein said light emitting device is a light emitting diode.

* * * * *